US008449251B2

(12) United States Patent
Lu

(10) Patent No.: US 8,449,251 B2
(45) Date of Patent: May 28, 2013

(54) FAN MODULE

(75) Inventor: Tung-Ke Lu, Taipei Hsien (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 352 days.

(21) Appl. No.: 12/902,158

(22) Filed: Oct. 12, 2010

(65) Prior Publication Data

US 2012/0087789 A1 Apr. 12, 2012

(51) Int. Cl.
*F04D 29/64* (2006.01)

(52) U.S. Cl.
USPC ..... 415/213.1

(58) Field of Classification Search
USPC ..... 415/213.1
See application file for complete search history.

(56) References Cited

U.S. PATENT DOCUMENTS 7,048,498 B2 * 5/2006 Kosugi ..... 415/213.1

FOREIGN PATENT DOCUMENTS

CN 1520253 8/2004

OTHER PUBLICATIONS

"Office Action of Taiwan counterpart application" issued on Jan. 2, 2013, p1-p4, in which the listed reference was cited.

* cited by examiner

*Primary Examiner* — Richard Edgar
(74) *Attorney, Agent, or Firm* — Chun-Ming Shih

(57) ABSTRACT

A fan module includes two brackets, a holder, and a fan. Each of the brackets has a first assembling portion. The holder has a U-shape body and an opening, and two of the second assembling portions are respectively disposed at two sides of the U-shape body. The fan is placed into the U-shape body through the opening. The holder is disposed between the brackets, and the first assembling portions of the brackets are assembled to the second assembling portions of the U-shape body. Screws are not required for assembling the fan module of the invention, and therefore material costs of the fan module can be reduced.

6 Claims, 3 Drawing Sheets

FAN MODULE

BACKGROUND OF THE INVENTION

1. Field of the Invention

The invention relates to a fan module, and more particularly, to a fan module with ease of assembly.

2. Description of Related Art

FIG. 1 is a schematic exploded view of a conventional fan module. With reference to FIG. 1, according to the related art, a fan 110 and a holder 120 are assembled by using a plurality of screws 130 that directly pass through fixing holes 122 of the holder 122, and the screws 130 are secured into fixing holes 112 located at four corners of the fan 110. However, manual use of the screws 130 requires labor time and costs of the screws 130.

SUMMARY OF THE INVENTION

The invention is directed to a fan module with ease of assembly.

The invention provides a fan module including two brackets, a holder, and a fan. Each of the brackets has a first assembling portion. The holder has a U-shape body and an opening, and two of the second assembling portions are respectively disposed at two sides of the U-shape body. The fan is placed into the U-shape body through the opening. The holder is disposed between the brackets, and the first assembling portions of the brackets are assembled to the corresponding second assembling portions of the U-shape body.

According to an embodiment of the invention, the U-shaped body has two latching portions and a connecting portion connected between the two latching portions. The opening is located between the latching portions. When the fan is placed into the U-shaped body of the holder, the connecting portion is bent, such that the latching portions are relatively away from each other to increase a diameter of the opening. Besides, the latching portions and the connecting portion are in a plate-like shape, and the connecting portion are further formed a plurality of hollow portions. The latching portions of the U-shaped body have a plurality of first latching units. The fan has a plurality of second latching units corresponding to the first latching units. When the fan is placed into the U-shaped body of the holder, the first latching units correspondingly latch the second latching units. The first latching units may be protruding points or bumps, and the second latching units may be recesses or openings.

According to an embodiment of the invention, the first assembling portions are slots, and the second assembling portions are protruding shafts.

Based on the above, the U-shaped body of the holder in the fan module of the invention is resilient, and therefore an assembler can bend the U-shaped body to make the two latching portions relatively away from each other, and thus the fan can be easily assembled into the U-shaped body. The fan is then fixed to the body by means of the latching units. Thereafter, the first assembling portions and the second assembling portions are combined to complete the assembly of the fan module. Since no screw is required for assembling the fan module of the invention, labor costs and material costs can be effectively reduced according to the invention in comparison with the related art.

In order to make the aforementioned and other features and advantages of the invention more comprehensible, embodiments accompanying figures are described in detail below.

DESCRIPTION OF EMBODIMENTS

Figure 1:
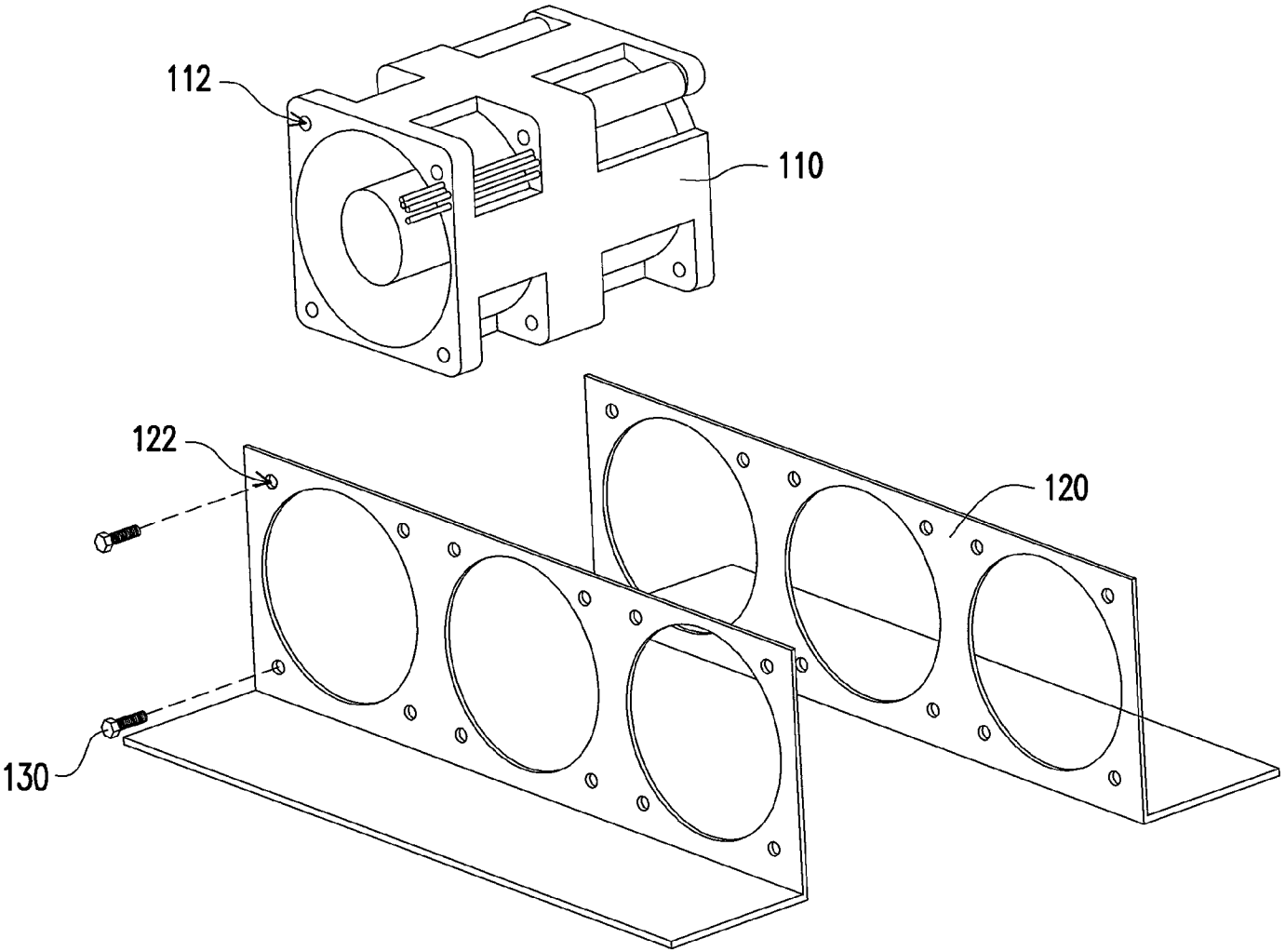
FIG. 1 (PRIOR ART)
FIG. 1 is a schematic exploded view of a conventional fan module.
Figure 2:
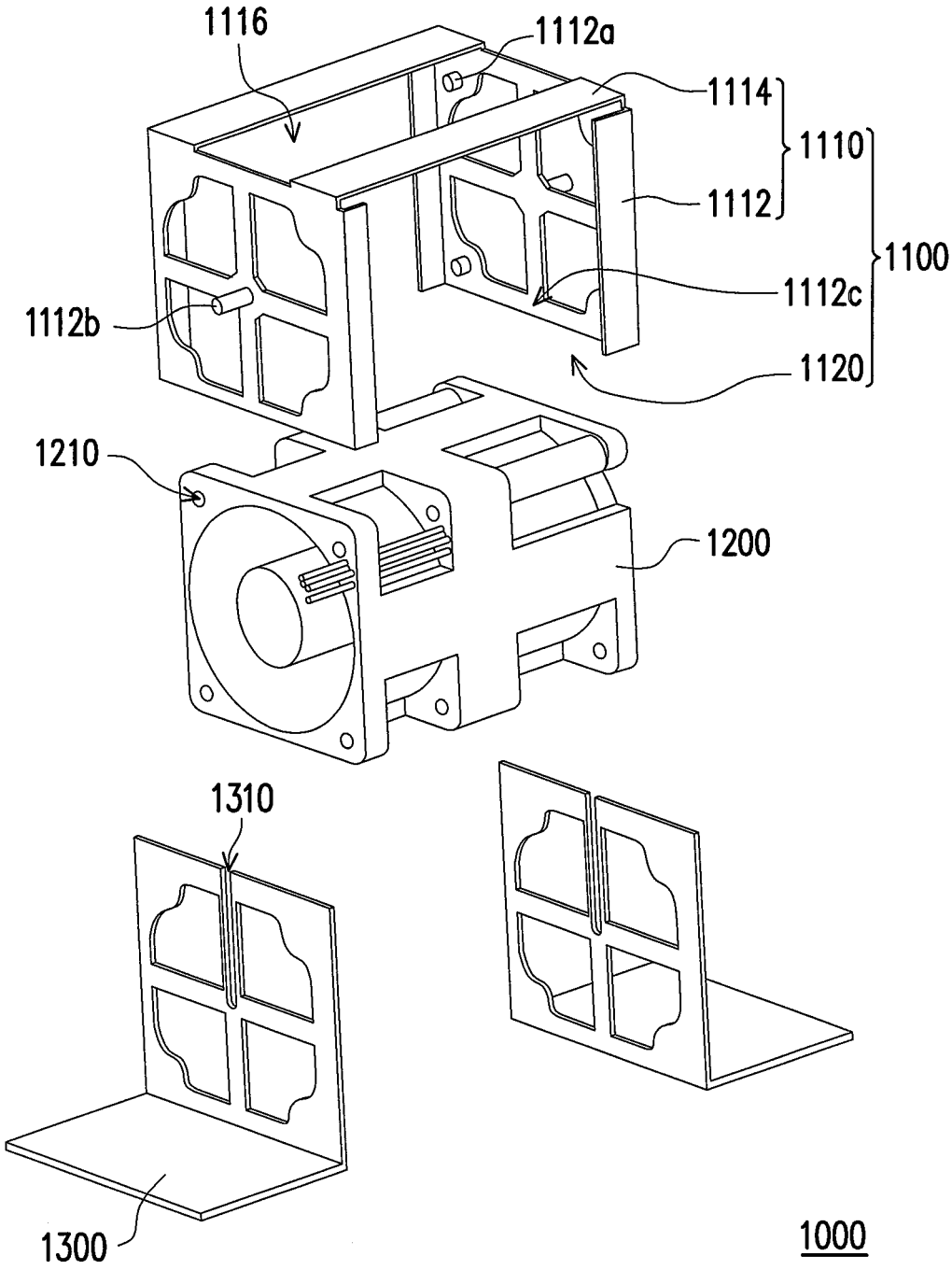
FIG. 2 is a schematic exploded view of a fan module according to an embodiment of the invention.
Figure 3:
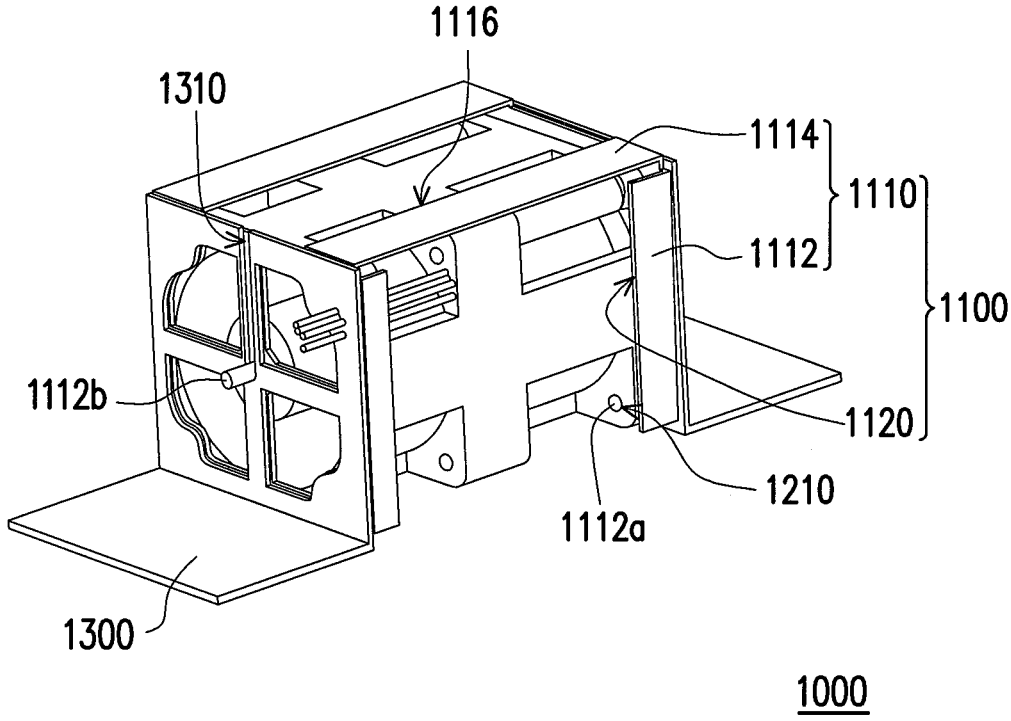
FIG. 3 is a schematic view of assembling the fan module depicted in FIG. 2.

FIG. 2 is a schematic exploded view of a fan module according to an embodiment of the invention. FIG. 3 is a schematic view of assembling the fan module depicted in FIG. 2. With reference to FIG. 2 and FIG. 3, a fan module 1000 includes a holder 1100, a fan 1200, and two brackets 1300. The holder 1100 is disposed between the brackets 1300, and the holder 1100 has a U-shaped body 1110 and an opening 1120. When the fan 1200 and the holder 1100 are assembled together, the fan 1200 is placed into the U-shaped body 1100 through the opening 1120.

The U-shaped body 1110 of the holder 1100 has two latching portions 1112 and a connecting portion 1114 connected between the two latching portions 1112, and the opening 1120 is located between two of the latching portions 1112. Here, the latching portions 1112 and the connecting portion 1114 can be in a plate-like shape.

Additionally, the latching portions 1112 of the U-shaped body 1110 may have a plurality of first latching units 1112*a* located on inner surfaces 1112*c* of the latching portions 1112. The fan 1200 has a plurality of second latching units 1210 corresponding to the first latching units 1112*a*. The first latching units 1112*a* are protruding points, and the second latching units 1210 are openings. Based on actual demands, people having ordinary skill in the art are able to change the material of the U-shaped body 1110 and the shape of the first and second latching units 1112*a* and 1210. For instance, the U-shaped body 1110 can be made of plastic or metal. In addition, the first latching units 1112*a* can be bumps, and the second latching units 1210 can be recesses. Certainly, the first latching units 1112*a* can be openings or recesses formed by punching the latching portions 1112 which are metal plates, and the second latching units 1210 can be protruding points or bumps formed by injection molding.

When the fan 1200 is placed into the U-shaped body 1110 of the holder 1100, the two latching portions 1112 can be pulled open by an assembler, and free ends of the two latching portions 1112 are relatively away from each other due to the resilient force of the U-shaped body 1110. Thereby, the diameter of the opening 1120 is increased, such that it is easy for the assembler to place the fan 1200 into the U-shaped body 1110 through the opening 1120.

After the fan 1200 is placed into the U-shaped body 1110 of the holder 1100, the assembler can stop applying forces to the two latching portions 1112. Instead, the resilience of the U-shaped body 1110 allows the free ends of the two latching portions 1112 to return to the original position. Here, the first latching units 1112*a* of the latching portions 1112 correspondingly latch the second latching units 1210 of the fan 1200, and thereby the fan 1200 is fixed to the brackets 1100.

As indicated above, the fan 1200 can be easily placed into the holder 1100 after the two latching portions 1112 of the U-shaped body 1100 are pulled open by the assembler and away from each other. Besides, each of the brackets 1300 has a first assembling portion 1310, and a second assembling portion 1112*b* is disposed on each of the latching portions 1112 of the U-shaped body 1110. The first assembling portions 1310 are slots formed on the edge of the brackets 1300, for instance, and the second assembling portions 1112*b* are protruding shafts. When the assembly of the fan 1200 and the holder 1100 is assembled to the brackets 1300, the second assembly structures (protruding shafts) 1112*b* of the latching portions 1112 of the U-shaped body 1110 are placed into the first assembling portions (slots) 1310, therefore the assembling steps are easy and simple. It can be deduced from the above that the assembly of the fan module 1000 does not require screws according to the present invention. From the assembler's point of view, the fan module 1000 of the present invention can be easily assembled in comparison with the conventional fan module that requires the assembler to assemble the holder and the fan together by passing the screws through the holder and the fan with use of a screwdriver. Moreover, since no screw is required in the assembly process, costs can be reduced as well.

On the other hand, the connecting portion 1114 of the U-shaped body 1110 can be formed a plurality of hollow portions 1116 thereon for reducing the entire weight.

In light of the foregoing, since screws are not required for assembling the fan module of the invention, material costs of the screws are avoided. Furthermore, resilience of the holder allows the assembler to assemble the fan and the holder together in an easy and simple manner.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A fan module comprising:

two brackets, each of the brackets comprising a first assembling portion;

a holder comprising a U-shaped body, two second assembling portions respectively disposed at two sides of the U-shaped body, and an opening defined by the U-shaped body; and a fan placed into the U-shaped body through the opening, the holder being disposed between the brackets, wherein the first assembling portions of the brackets are assembled to the second assembling portions of the U-shape body correspondingly, the first assembling portions are slots, and the second assembling portions are protruding shafts.

2. The fan module as claimed in claim 1, wherein the U-shaped body has two latching portions and a connecting portion connected between the two latching portions, the opening is located between the latching portions, the connecting portion is bent when the fan is placed into the U-shaped body of the holder, such that the latching portions are relatively away from each other to increase a diameter of the opening.

3. The fan module as claimed in claim 2, wherein the latching portions and the connecting portion are in a plate-like shape.

4. The fan module as claimed in claim 3, wherein the connecting portion are further formed a plurality of hollow portions for reducing a weight of the U-shaped body.

5. The fan module as claimed in claim 2, wherein the latching portions of the U-shaped body have a plurality of first latching units, the fan has a plurality of second latching units corresponding to the first latching units, and when the fan is placed into the U-shaped body of the holder, the first latching units correspondingly latch the second latching units.

6. The fan module as claimed in claim 5, wherein the first latching units are protruding points or bumps, and the second latching units are recesses or openings.

* * * * *